US005623747A

United States Patent [19]

Marinoni

[11] Patent Number: 5,623,747

[45] Date of Patent: Apr. 29, 1997

[54] FLOOR-MOUNTED DOOR CLOSER DEVICE

[75] Inventor: Mario Marinoni, Magenta, Italy

[73] Assignee: Societa Italiana Proquetti S.r.l., Magenta, Italy

[21] Appl. No.: 505,204

[22] PCT Filed: Dec. 22, 1994

[86] PCT No.: PCT/EP94/04285

§ 371 Date: Aug. 15, 1995

§ 102(e) Date: Aug. 15, 1995

[87] PCT Pub. No.: WO95/17573

PCT Pub. Date: Jun. 29, 1995

[30] Foreign Application Priority Data

Dec. 22, 1993 [DE] Germany ..... 9319769 U

[51] Int. Cl.[6] ..... E05F 3/00

[52] U.S. Cl. ..... 16/49; 16/55; 16/50; 16/378

[58] Field of Search ..... 16/49, 50, 51, 16/53, 55, 378, DIG. 9, DIG. 10

[56] References Cited

U.S. PATENT DOCUMENTS

| | | | |
|---|---|---|---|
| 1,773,988 | 8/1930 | Garrison | 16/55 |
| 2,085,593 | 6/1937 | Lasier | 16/51 |
| 2,603,818 | 7/1952 | Carlson | 16/55 |
| 2,752,627 | 7/1956 | Carlson | 16/55 |
| 3,576,046 | 4/1971 | Czapar | 16/55 |

FOREIGN PATENT DOCUMENTS

| | | | |
|---|---|---|---|
| 2840725 | 3/1980 | Germany | 16/49 |

*Primary Examiner*—M. Rachuba
*Assistant Examiner*—Christopher Kirkman
*Attorney, Agent, or Firm*—Barnes, Kisselle, Raisch, Choate, Whittemore & Hulbert, P.C.

[57] ABSTRACT

A floor-mounted door closure device comprising a floor trough insertable in a cavity of the floor and arranged to receive the closer casing from which a pivot pin projects, the device further comprising a cover plate covering the floor trough and closer casing. The cover plate is designed as a carrier for a material layer made of flooring material and is supported on the floor trough such that the cover plate is sunk in the cavity and the material layer carried by the cover plate is substanatially flush with the surface of the flooring material surrounding the cavity.

10 Claims, 4 Drawing Sheets

FLOOR-MOUNTED DOOR CLOSER DEVICE

DESCRIPTION

The present invention relates to a floor-mounted door closer device of the type specified in the preamble of claim 1. Such a floor-mounted door closer device is of customary design as described in DE 3937262 A1, for example.

In the floor-mounted door closer devices which have been used hitherto, the cover plate for covering the floor cavity receiving the floor-mounted door closer device bears on the flooring material surrounding the cavity, i.e. the cover plate constitutes a projection from the flooring material. This makes the floor difficult to clean in the vicinity of the floor-mounted door closer device. The cover plate is made of a metal, such as aluminium, steel or brass, and although attempts have been made to give the surface of the cover plate a visually attractive design, e.g. of anodised aluminium, the cover plate nevertheless always constitutes a visual interruption of the surface formed by the flooring material. In addition, wear or environmental influence, for instance abrasion and oxidation, often cause changes in color, mainly affecting the edges of the cover plate.

This can impair the visual overall appearance of the door provided with the floor-mounted door closer device, if for example the door is made entirely of glass and substantially no materials other than the door glass and flooring material are supposed to be visible.

The object of the invention is to design the cover means of a floor-mounted door closer device of the abovementioned type such that the visual overall appearance provided by the flooring material in the area of the floor-mounted door closer device is only interrupted and impaired to the smallest extent possible.

According to the invention, the object is achieved by the features of claim 1. The dependent claims concern further advantageous embodiments of the invention.

The cover of the floor-mounted door closer device according to the invention has an upper surface consisting of the same material as the surrounding flooring material and is substantially flush therewith. This arrangement accomplishes the visual appearance of a jointless flooring material which is continuous even in the area of the floor-mounted door closer device. Cleaning of this floor area is facilitated, and subsequent color changes will not occur or will occur only to the same degree as in the adjacent flooring material.

According to a preferred embodiment of the invention, the cover plate comprises reinforcing means, in particular if the cover plate is arranged as a flat rectangular box open on its top side. As an alternative, the cover plate can be borne by a stable supporting plate arranged beneath the cover plate and supporting substantially the entire surface of the latter, this feature being known as such from DE 3937262 A1 already referenced above. According to the invention, however, this supporting plate is designed as a flat box open on its top side, in which the cover plate is detachably inserted.

In order to allow the cover plate and, as the case may be, the supporting plate to be inserted and taken out without having to detach the door from the pivot pin of the floor-mounted door closer device, the cover plate and, as the case may be, the supporting plate are divided, i.e. assembled from two pieces, in the region of the through-hole for the pivot pin, various ways of implementation being possible for the type of this division within the scope of the invention.

Embodiments of the invention will be described in greater detail having reference to the drawings, wherein FIG. 1 is a perspective view of the components of the floor-mounted door closer device according to an embodiment of the invention;

Figure 1:
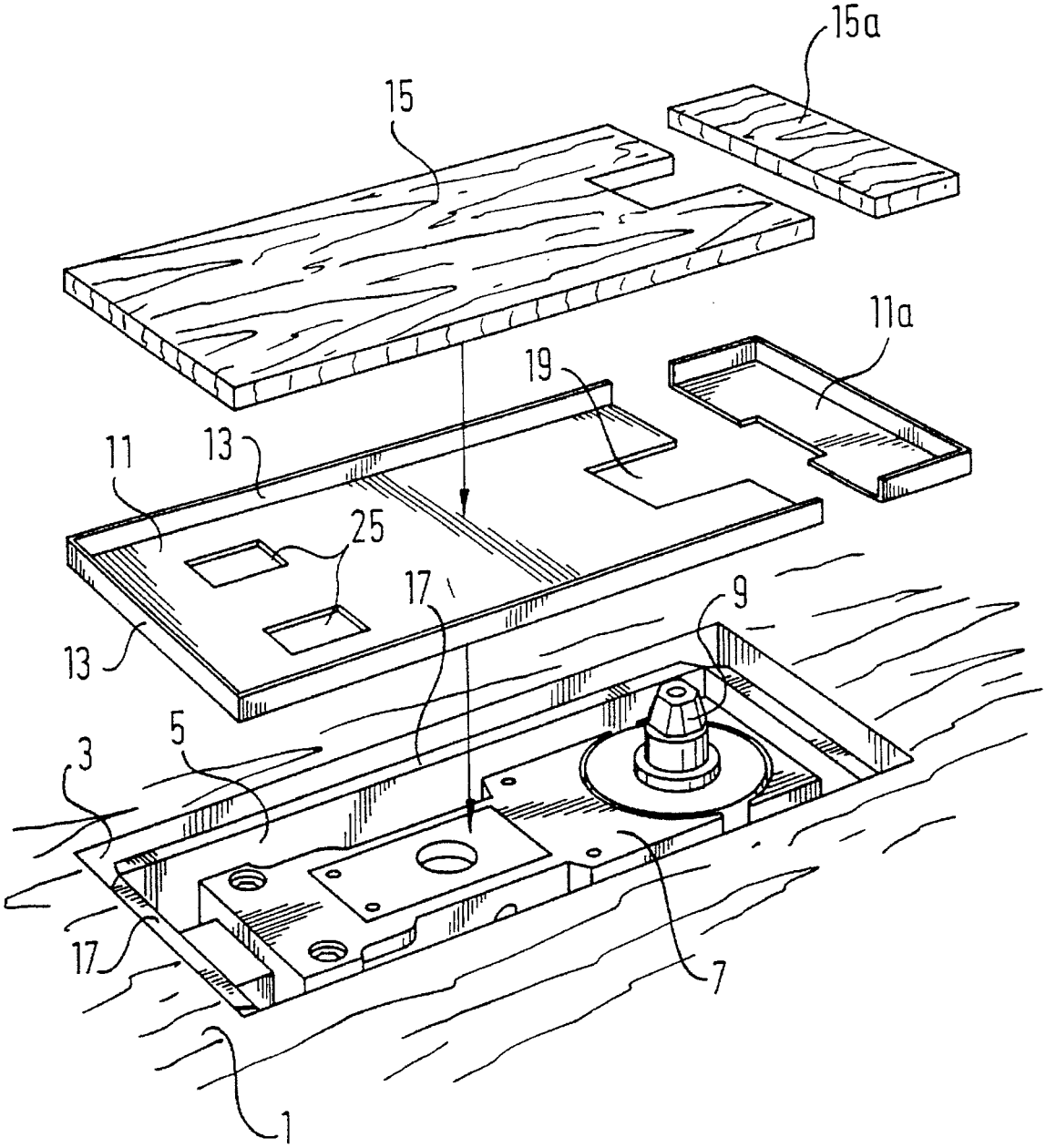
Figure 3A:
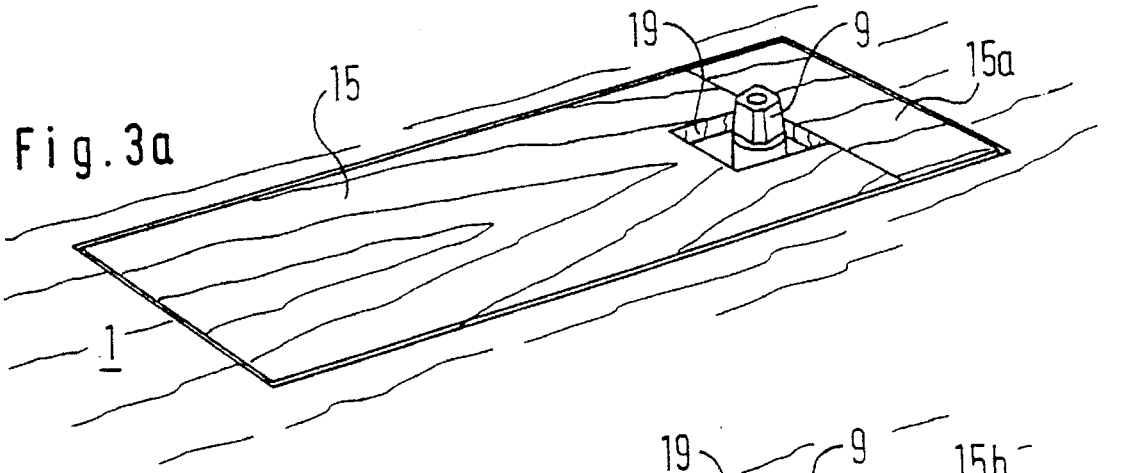
FIG. 3 is a perspective plan view of the mounted cover plate of the floor-mounted door closer device according to four different embodiments of the invention.

According to FIG. 1, a rectangular cavity 3 is arranged in the floor covered with a flooring material i, and a floor trough 5, often also called cementing trough, is inserted in cavity 3. The floor trough 5 receives the closer casing 7 of the floor-mounted door closer device, said casing 7 comprising the usual closing mechanism hydraulically absorbing the drive energy of the closing source; the upwardly projecting pivot pin 9 of the closing mechanism is conventionally connected to the door leaf (not shown). The closer casing 7 is anchored in the floor trough 5 by adjustable anchoring means (not shown) such that the pivot pin 9 can be set to the desired axis of rotation of the door leaf. The floor trough 5 is in turn firmly anchored, e.g. cemented, in cavity 3. The elements of the floor-mounted door closer device described so far are of conventional structure and will not therefore be explained in greater detail. A cover plate 11 is provided to cover the cavity 3 and the floor-mounted door closer device arranged therein. Cover plate 11 is formed as a flat box open on its top side and having side walls 13, and serves to receive a material layer 15 made of the same flooring material as the flooring material 1 adjacent to cavity 3. The exterior dimensions of cover plate 11 are slightly smaller than those of cavity 3 so that the cover plate 11 can be sunk into cavity 3 and supported by outwardly bent flanges 17 of the floor trough 5. Taking account of the thickness of material layer 15 and cover plate 11, the vertical distance between the flanges 17 and the upper surface of the flooring material 1 is chosen such that the upper surface of material layer 15 is substantially flush with the flooring material 1, as illustrated in FIG. 3*a*.

The cover plate 11 has a recess 19 through which the pivot pin 9 of the floor-mounted door closer device projects, and is divided—in the area of said recess 19—into the main part 11 and a smaller part 11*a*. Accordingly, the material layer 15 is also divided in the area of the opening through which the pivot pin 9 passes, and comprises a smaller part 15*a*.

Figure 3B:
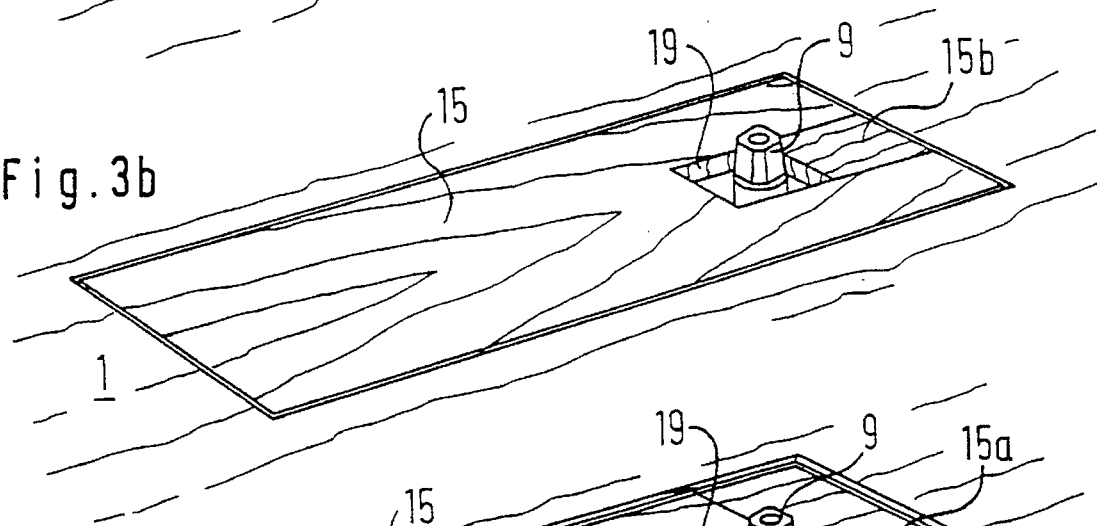

As shown in FIG. 3*b*, the division in the area of the opening 19 for pivot pin 9 may alternatively be achieved in a different fashion, for example by two cuts parallel to the longitudinal extension of cover plate 11 so that only a narrow plate-like additional piece 15b need be inserted.

Figure 2:
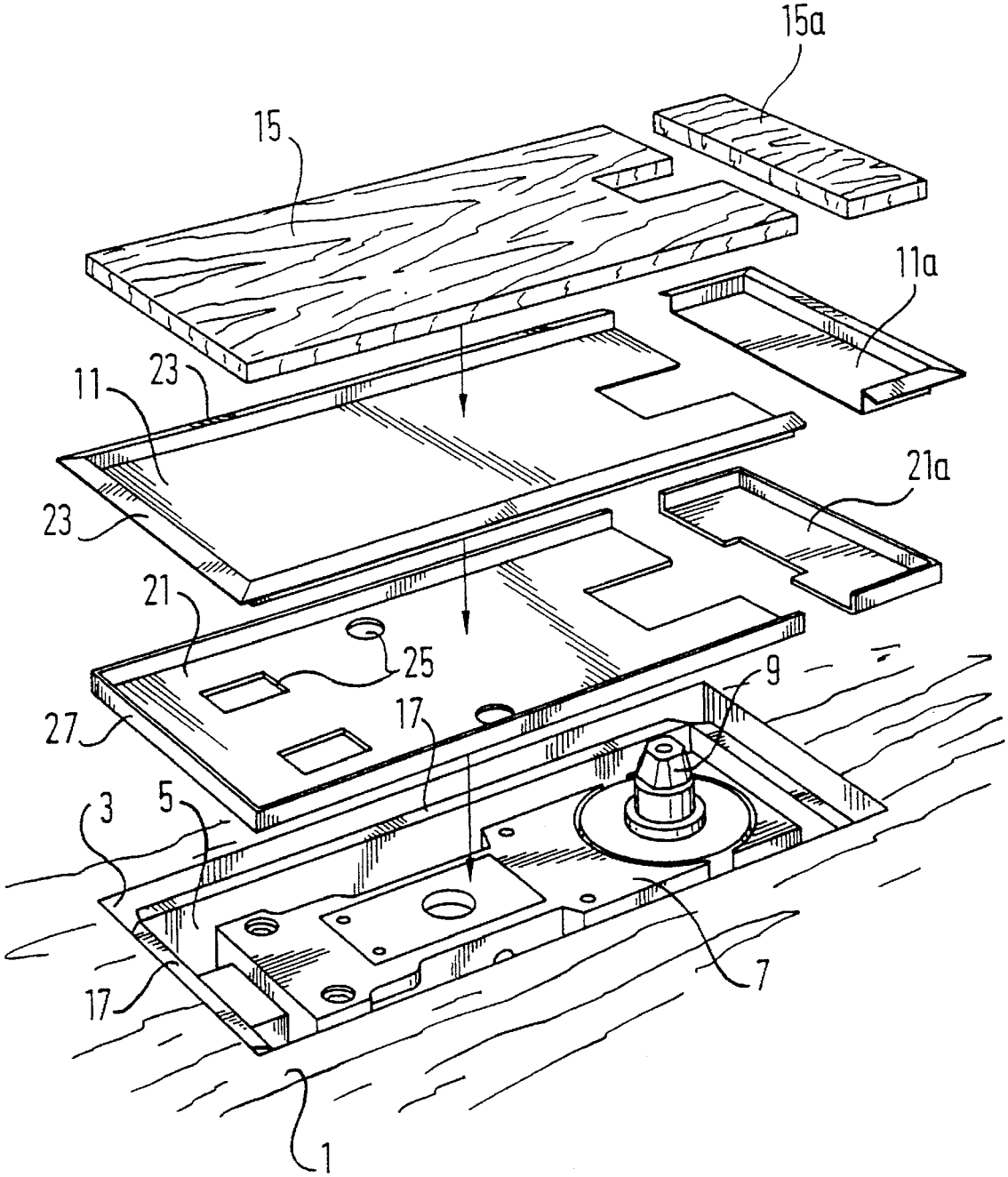
FIG. 2 is a similar illustration of the components of a modified embodiment.

FIG. 2 illustrates a modified embodiment of the invention. In this embodiment, a supporting plate 21 is additionally provided beneath the cover plate 11 and placed on the flange 17 of floor trough 5 to support the whole surface of the actual cover plate 11. The supporting plate 21 can be made of a material thicker than that of cover plate 11 and serves to receive the point-contact and surface-contact loads which the cover plate 11 and the material layer 15, respectively, experience when they are loaded. The cover plate 11 may therefore be made of a relatively thin material.

In the embodiment shown, the cover plate 11 is additionally provided with an outwardly projecting border 23, extending horizontally or slightly descending outwardly, to cover the joint between the cover plate 11 and the flooring material 1 after the cover plate 11 has been fitted.

As shown in FIG. 2, the supporting plate 21 is also divided in the area of the opening for pivot pin 9, and comprises a small supplementary part 21a so that the supporting plate 21 can likewise be attached or detached when the door leaf has already been fitted on pivot pin 9. The supporting plate 21 may comprise holes or windows 25 allowing access to the control means of the closer casing 7 even after assembly of the supporting plate 21 so that the attenuation characteristics of the closer mechanism can be modified and the pivot pin 9 adjusted even with the supporting plate 21 mounted. Such windows 25 are equally provided in the cover plate 11 of the embodiment according to FIG. 1.

The supporting plate 21 as illustrated is formed as a flat box open on its top side and comprising lateral walls 27, into which the cover plate 11 can be fitted detachably, i.e. loosely or with slight pressure.

When the floor-mounted door closer device according to the invention is mounted, the supporting plate 21 is first fixed on the floor trough 5 to cover and protect the floor trough 5 and closer casing 7 during the construction period. If desired, the supporting plate 21 may also serve as a template to the person placing the flooring material 1, for cutting the cut 3 therein. In the meantime, a sample of the flooring material 1 in the factory is cut to a material layer 15, 15*a* of suitable dimensions and, if necessary, of suitable thickness, and fitted into the cover plate 11. Upon completion of the construction work, the cover plate 11, 11*a* carrying the material layer 15, 15*a* can then be inserted in the supporting plate 21 already present.

Figure 3C:
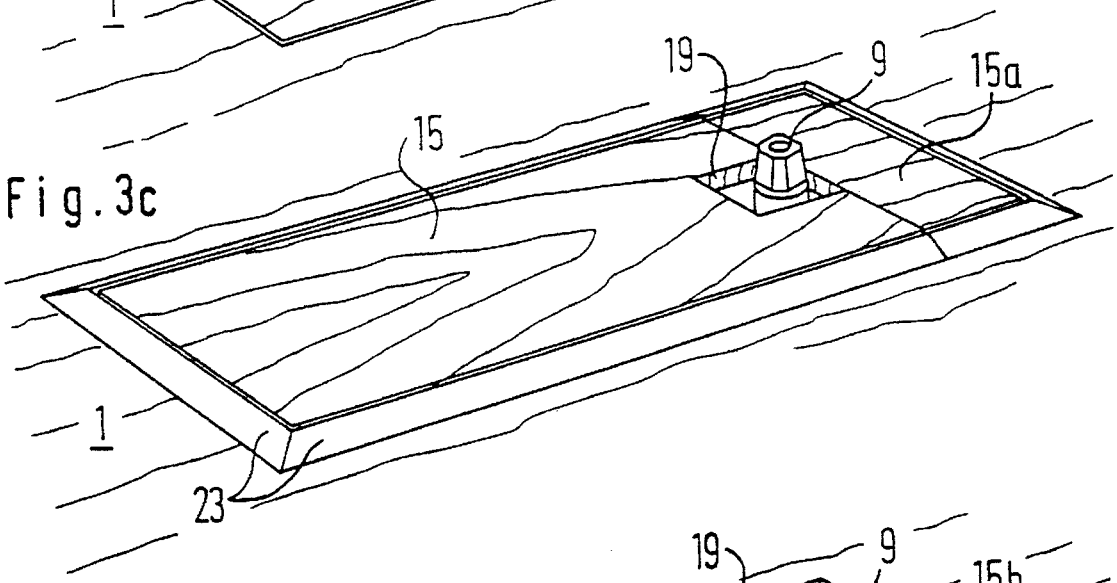

FIG. 3*c* is a plan view of the floor-mounted door closer device after assembly according to the embodiment shown in FIG. 2. Due to the slightly ascending border 23 of cover plate 11, the top face of the material layer 15 is slightly raised with respect to the surface of the neighboring flooring material 1; the border 23, however, provides a transition so that the whole floor surface can be cleaned without obstruction.

Figure 3D:
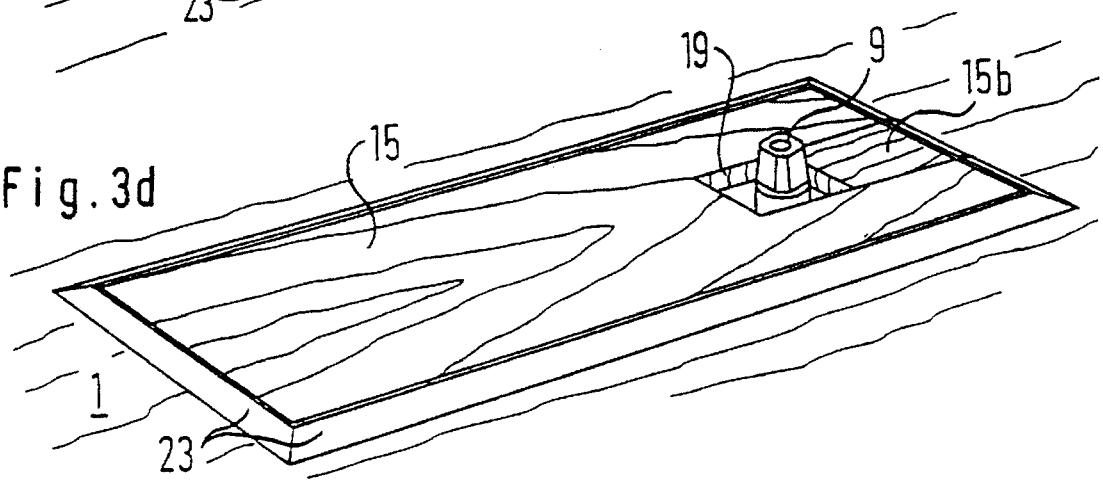

As shown in FIG. 3*d*, the area of the opening 19 for passing pivot pin 9 in this embodiment can also be divided in a different way, namely parallelly to the longitudinal extension of the cover plate 11, thus forming a small plate-like insert piece 15*b*.

As a matter of fact, the border 23 of cover plate 11 can be also omitted in the embodiment according to FIG. 2. On the other hand, the cover plate 11 in the embodiment according to FIG. 1 may also be provided with a border 23 like that shown in FIG. 2.

Figure 4:
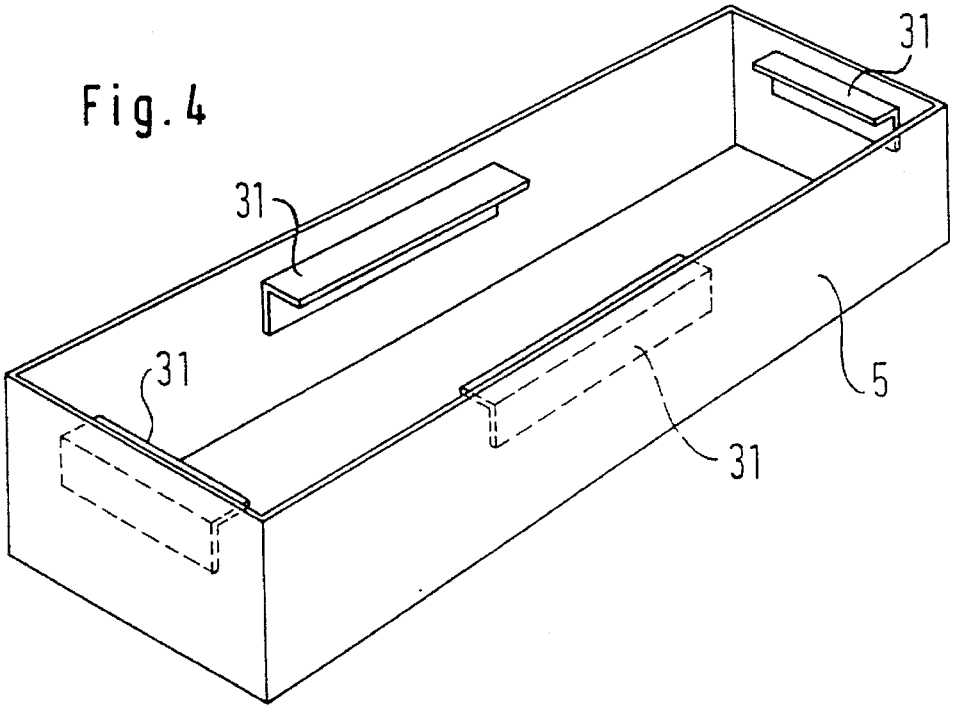
FIG. 4 is a perspective view of a modified embodiment of the floor trough of the floor-mounted door closer device.

FIG. 4 shows a modified version of a floor trough 5 lacking any outwardly bent edge flange 17 but comprising corner brackets 31 on which the cover plate 11 according to FIG. 1 or the supporting plate 21 according to FIG. 2 can be seated.

FIGS. 5 to 8 show cross-sections of various design options in the area of the joint between the cover and the adjacent flooring material.

Figure 5:
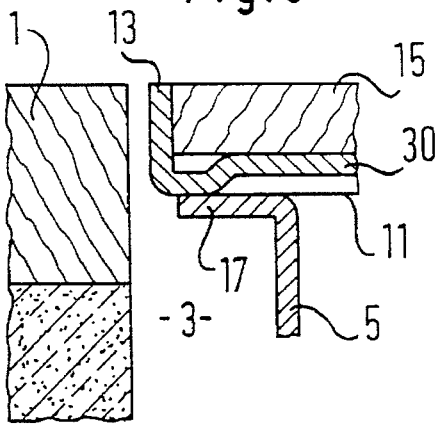
FIGS. 5 to 8 are sectional views of details in the area of the join: between the cover plate and the adjacent flooring material, for various embodiments of the invention.

FIG. 5 corresponds to the embodiment according to FIG. 1, except for the differences described below, wherein only the upper edge of side wall 13 of cover plate 11 is visible between the material layer 15 and the adjacent flooring material 1.

Figure 6:
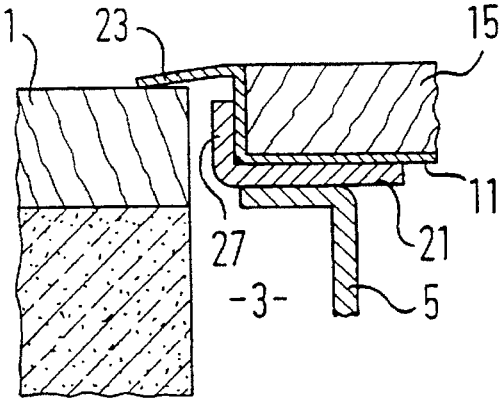

FIG. 6 corresponds to the embodiment according to FIG. 2 wherein the slightly descending border 23 covers the joint between the material layer 15 and the adjacent flooring material 1 so that the lateral wall 27 of the supporting plate 21 is also covered The border 23 thus forms a metal frame for the material layer 15 consisting of flooring material. It will be appreciated that the visible portion of cover plate 11 in the range of border 23 is made from a visually attractive material which goes well with the flooring material 1; in this connection, the choice between the materials suitable for the cover plate 11, such as aluminium, brass, or special steel, can be made considering the respective flooring material, such as marble, parquet, or fabric. If a supporting plate 21 is used to support the cover plate over its whole surface, the material of the cover plate it can be chosen substantially independently of any strength considerations, but on the basis of purely decorative aspects.

Figure 7:
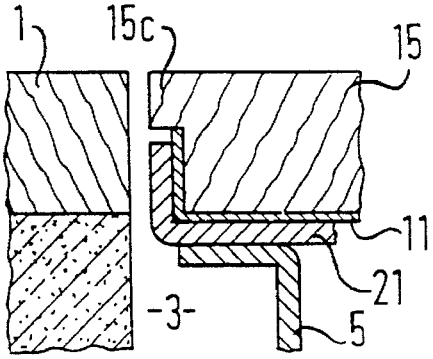

In the embodiment according to FIG. 7, the height of the side wall 13 of cover plate 11 and, if present, the height of the lateral wall 27 of supporting plate 21 is smaller than the thickness of the material layer 15 of cover plate 11. The edge of material layer 15 comprises a projecting nose 15*c* extending above and beyond the side walls 13 and lateral walls 27 of the cover plate 11 and supporting plate 21, respectively. On the floor surface, only a narrow joint is therefore visible between the flooring material 1 and the layer 15 of flooring material 1, whereas the metal material of the cover plate 11 and supporting plate 21 is entirely hidden.

Figure 8:
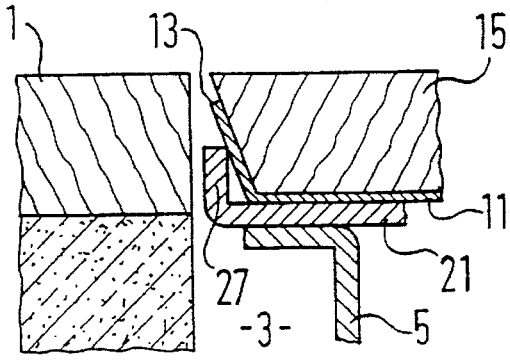

In the embodiment according to FIG. 8, the side walls 13 of cover plate 11 are sloped outwardly, and the periphery of the layer 15 of flooring material is correspondingly bevelled or brought into a wedge-like shape such that the upper edge of material layer 15 extends beyond the side wall 13 of cover plate 11 to hide the latter. Likewise, the lateral wall 27 of supporting plate 21 is thus covered and invisible.

To facilitate removal of the cover plate 11 fitted in supporting plate 21, the cover plate 11 and supporting plate 21 may be designed such that a small eccentric zone of the cover plate 11, in particular its end opposite to pivot pin 9, is not supported. By exerting a pushing force from above onto this zone, the cover plate 11 can be tilted relative to the supporting plate 21 so that a different zone of the cover plate 11 is lifted from the supporting plate 21 and can be gripped.

In the embodiment according to FIG. 5, the bottom of cover plate 11 is provided with reinforcement ribs 30 extending transversely to the longitudinal axis of cover plate 11 and projecting upwardly, said ribs 30 being formed as beads that are open towards the bottom. Alternatively; the bottom of cover plate 11 may be thicker than the side walls 13 thereof, or a reinforcement grid may be arranged on the bottom of cover plate 11 to reinforce the bottom. It is also possible, for example, to provide reinforcement ribs 30 on the underside of cover plate 11.

I claim:

1. Floor-mounted door closer device comprising a floor trough (5) insertable in a cavity (3) of a floor and arranged to receive a closer casing (7) from which a pivot pin (9) projects, the device further comprising a cover plate (11) covering the floor trough (5) and closer casing (7), characterised in that the cover plate (11) has a material layer (15) made of flooring material positioned thereon, and is supported on the floor trough (5) such that the cover plate (11) is sunk in the cavity (3) and the material layer (15) positioned on the cover plate (11) is substantially flush with the surface of the flooring material (1) surrounding the cavity, wherein the cover plate comprises a flat rectangular box having side walls which is open on its top side and is filled with the material layer made of flooring material.

2. Floor-mounted door closer device according to claim 1, characterised in that the cover plate (11) comprises reinforcement ribs (30).

3. Floor-mounted door closer device according to claim 1, characterised in that the cover plate (11) is supported by a supporting plate (21) seated on the floor trough (5) and supporting substantially the whole surface of the cover plate (11).

4. Floor-mounted door closer device according to claim 3, characterised in that the supporting plate (21) is in the form of a flat rectangular box open on its top side and comprising lateral walls (27), the cover plate (11) being detachably inserted in said rectangular box.

5. Floor-mounted door closer device according to claim 1, characterised in that the cover plate (11) and/or the supporting plate (21) each comprise an opening (19) for passing the pivot pin (9), and are each divided in the area of said opening.

6. Floor-mounted door closer device according to claim 1, characterised in that the cover plate (11) and/or the supporting plate (21) each comprise holes or windows (25) allowing access no control means of the closer casing (7).

7. Floor-mounted door closer device according to claim 1, characterised in that the height of the side walls (13) of the cover plane (11) and/or the height of the lateral walls (27) of the supporting plate (21) is smaller than the thickness of the material layer (15), and the material layer (15) extends laterally beyond the side walls and lateral walls, respectively.

8. Floor-mounted door closer device according to claim 1, characterised in that the cover plate (11) comprises an outwardly projecting border (23) forming a circumferential rectangular frame covering the joint between the, cover plate (11) and the surrounding flooring material (1).

9. Floor-mounted door closer device according to claim 1, characterised in that outwardly or inwardly bent flanges (17) are provided on the upper edge of the floor trough (5) to support the cover plate (11) or the supporting plate (21), respectively.

10. Floor-mounted door closer device according to claim 1, characterised in that corner brackets (31) are arranged on the inner walls of the floor trough (5), beneath its upper edge, to support the cover plate (11) or the supporting plate (21), respectively.

* * * * *

UNITED STATES PATENT AND TRADEMARK OFFICE

CERTIFICATE OF CORRECTION

PATENT NO. : 5,623,747
DATED : April 29, 1997
INVENTOR(S) : Mario Marinoni

It is certified that error appears in the above-indentified patent and that said Letters Patent is hereby corrected as shown below:

On the title page, item [73] Assignee: should read

-- Societa Italiana Progetti, S.r.l. --

Signed and Sealed this

Fourteenth Day of October, 1997

*Attest:*

*Attesting Officer*

Bruce Lehman

BRUCE LEHMAN

*Commissioner of Patents and Trademarks*